US008834775B2

(12) United States Patent
Ishikawa et al.

(10) Patent No.: US 8,834,775 B2
(45) Date of Patent: Sep. 16, 2014

(54) METHOD OF MANUFACTURING NANOFIBERS

(75) Inventors: Kazunori Ishikawa, Osaka (JP); Hiroto Sumida, Nara (JP); Takahiro Kurokawa, Osaka (JP); Masanobu Miyata, Osaka (JP); Takatoshi Mitsushima, Nara (JP)

(73) Assignee: Panasonic Corporation, Osaka (JP)

( * ) Notice: Subject to any disclaimer, the term of this patent is extended or adjusted under 35 U.S.C. 154(b) by 193 days.

(21) Appl. No.: 13/258,128

(22) PCT Filed: Aug. 11, 2010

(86) PCT No.: PCT/JP2010/005037

§ 371 (c)(1), (2), (4) Date: Sep. 21, 2011

(87) PCT Pub. No.: WO2011/030506

PCT Pub. Date: Mar. 17, 2011

(65) Prior Publication Data

US 2012/0013047 A1 Jan. 19, 2012

(30) Foreign Application Priority Data

Sep. 9, 2009 (JP) ..... 2009-208727

(51) Int. Cl.
*D01D 7/00* (2006.01)
*D01D 5/00* (2006.01)

(52) U.S. Cl.
CPC ..... *D01D 5/0069* (2013.01); *D01D 5/0038* (2013.01)
USPC ..... 264/465; 264/211.12

(58) Field of Classification Search
USPC ..... 264/211.12, 464, 465, 466, 484
See application file for complete search history.

(56) References Cited

U.S. PATENT DOCUMENTS

2002/0175449 A1* 11/2002 Chu et al. ..... 264/465
2011/0180951 A1* 7/2011 Teo et al. ..... 264/109

FOREIGN PATENT DOCUMENTS

| | | |
|---|---|---|
| CN | 1774321 | 5/2006 |
| JP | 41-7883 | 4/1966 |
| JP | 2008-38312 | 2/2008 |
| JP | 2008-50719 | 3/2008 |
| JP | 2008-174853 | 7/2008 |
| JP | 2008-174867 | 7/2008 |

(Continued)

OTHER PUBLICATIONS

International Search Report issued Nov. 22, 2010 in International (PCT) Application No. PCT/JP2010/005037.

(Continued)

*Primary Examiner* — Leo B Tentoni
(74) *Attorney, Agent, or Firm* — Wenderoth, Lind & Ponack, LLP

(57) ABSTRACT

A nanofiber manufacturing apparatus (100) which produces nanofibers (301) by electrically stretching a solution (300) in space. The apparatus includes: an effusing body (115) having effusing holes (118) for effusing the solution into the space, a tip part (116) in which openings (119) are arranged at given intervals, and two side wall parts (117) provided so as to extend from both sides of the tip part so that the effusing holes are located between the side wall parts and the distance between the side wall parts increases with the distance from the tip part; a charging electrode (121) disposed at a given distance from the effusing body; and a charging power supply (122) which applies a given voltage between the effusing body and the charging electrode.

4 Claims, 9 Drawing Sheets

(56) References Cited

FOREIGN PATENT DOCUMENTS

| | | | |
|---|---|---|---|
| JP | 2008223186 A | * | 9/2008 |
| JP | 2010-31398 | | 2/2010 |
| WO | 2004/080681 | | 9/2004 |

OTHER PUBLICATIONS

Chinese Office Action mailed Oct. 15, 2013 in corresponding Chinese patent application No. 201080015437.2 with English translation.

* cited by examiner (a)

(b)

METHOD OF MANUFACTURING NANOFIBERS

BACKGROUND OF THE INVENTION

1. Technical Field

The present invention relates to a nanofiber manufacturing apparatus which produces fibers having diameters of submicron order or nanometer order (referred to as nanofibers in this description) by electrostatic stretching, and a method of manufacturing nanofibers.

2. Description of the Related Art

There is a known method of manufacturing filamentous (fibrous) substances containing a resin and having a submicron- or nanometer-scale diameter by making use of electrostatic stretching (electrospinning).

The electrostatic stretching is a method of manufacturing nanofibers. In the method, a solution prepared by dispersing or dissolving a solute such as a resin in a solvent is effused (ejected) into space through a nozzle or the like, and the solution is charged and electrically stretched in flight so that nanofibers are produced.

The following describes the electrostatic stretching more specifically. The solvent gradually evaporates from the charged solution while the solution effused into space is in flight. The volume of the solution in flight thus gradually decreases while the charges imparted to the solution stays in the solution. As a result, the charge density of the solution in flight gradually increases. The solvent ongoingly evaporates and the charge density of the solution further increases, and the solution is explosively stretched into a line when the Coulomb force generated in the solution and repulsive to the surface tension of the solution surpasses the surface tension. This is how the electrostatic stretching occurs. The electrostatic stretching exponentially occurs in space one after another so that nanofibers having diameters of sub-micron orders or nanometer orders are produced.

One of the specific problems with an apparatus for manufacturing nanofibers by such electrostatic stretching is the difficulty of increasing productivity. For example, effusing solution through cylindrical nozzles arranged in a matrix increases a production rate per unit time and unit area so that productivity of nanofibers is increased. However, although the production rate of nanofibers per unit area can be further increased by narrowing intervals between the nozzles, narrower intervals may cause interference of electric fields between adjacent nozzles, which results in defects in generated nanofibers. In order to solve the problem, the apparatus according to JP2008-174867 includes separators which are arranged in a grid pattern among the nozzles and to which alternating voltage is applied so that interference of electric fields is prevented.

SUMMARY OF INVENTION

1. Technical Problem

However, in the technique disclosed in JP2008-174867, the intervals between the nozzles need to have a width required to accommodate the separators. As a result, productivity decreases for the increase in the intervals between the nozzles. In addition, because each of the nozzles are surrounded by the separators, the space surrounded by the separators is likely to have resident charged vapor which may cause a negative impact on resulting nanofibers. In addition, because it is difficult to provide solution to the nozzles at an even pressure, the quality of the resulting nanofibers may not be consistent.

Furthermore, the inventors of the present invention found that the ionic wind was generated from the external walls of the nozzles and the ionic wind causes a negative impact on resulting nanofibers even when such separators are provided.

The ionic wind is considered to be generated in the phenomenon described as follows. First, when charges accumulate on a part of an external wall, air around the part is ionized. Next, the ionized air repels charges on the wall, so that air containing ions flows so that ionic wind is generated. The inventors have also found that such ionic wind is likely to be generated at specific parts of the in external wall, such as the tip of a protrusion and the tip of a corner part.

In addition, when the ionic wind encounters a solution flying in space, the flight path of the solution and the nanofiber being produced is disrupted or the charging of the solution is adversely affected. As a result, the quality of the resulting nanofibers deteriorates and the productivity of the nanofibers decreases.

The present invention, based on considerations of the problems and the findings, has an object of providing a nanofiber manufacturing apparatus and a method of manufacturing nanofibers using which occurrence of interference of electric fields is prevented to keep a high production rate of nanofibers per unit hour and unit area and the impact of the ionic wind is limited so that nanofibers of high and consistent quality can be produced.

2. Solution to Problem

In order to achieve the object, the nanofiber manufacturing apparatus according to an aspect of the present invention produces nanofibers by electrically stretching a solution in space, and includes: an effusing body having, a plurality of effusing holes for effusing the solution into the space, a tip part in which openings at ends of the effusing holes are one-dimensionally arranged at given intervals, and two side wall parts provided extending from both sides of the tip part so that the effusing holes are located between the side wall parts and distance between the side wall parts increases with distance from the tip part; a charging electrode disposed at a given distance from the effusing body; and a charging power supply which applies a given voltage between the effusing body and the charging electrode.

With this, the spaces between the openings of the effusing holes arranged at given intervals are filled with the tip part so that interference of electric fields is unlikely to occur. As a result, the intervals between the openings from which a solution effuses are minimized and the production rate of nanofibers per unit area is increased.

In addition, in the structure in which the distance between the side wall parts of the effusing body is smallest at the tip part and increases with the distance from the openings, only limited ionic wind generated at the side wall parts flies in a direction such that the ionic wind causes a negative impact on the resulting nanofibers. In addition, ionic wind is unlikely to be generated at the surfaces of the side wall parts extending along the direction in which the openings are arranged. The effusing body can thus limit the effects of ionic wind on nanofibers.

Furthermore, the effusing body may further have a storage tank which is connected to the effusing holes, stores the solution supplied from the supply unit, and supplies the solution to the effusing holes at a time.

With this, the solution supplied from the supply unit is first stored in the supply unit and then supplied to the effusing holes, so that the solution is supplied to the effusing holes at pressures as uniform as possible. In addition, such an effect is achieved by a simple structure without additional parts.

Furthermore, the tip part may have a rectangular shape having a width which is larger than a diameter of the openings provided in the tip part.

With this, Taylor cones (for details, see Embodiment) generated around the openings are retained more favorably by the tip part. The solution thinly effuses from the Taylor cones, and then is electrostatically stretched. The joints between the effusing holes and the tip part are thus covered by the solution, so that generation of ionic wind is limited.

Furthermore, the nanofiber manufacturing apparatus may further include an accumulating unit on which the nanofibers produced in the space are accumulated; and an attracting unit configured to attract the nanofibers to the accumulating unit.

With this, nanofibers to be accumulated are selectively limited so that functional material can be produced.

Furthermore, the nanofiber manufacturing apparatus may further include a moving unit configured to move at least one of the effusing body and the accumulating unit relative to each other.

With this, nanofibers can be accumulated evenly over a wide area.

Furthermore, the effusing body preferably has a structure which allows (i) disassembly of the effusing body into parts to expose surfaces forming the effusing holes and (ii) re-assembly of the parts into the effusing body.

The effusing body has increased maintainability.

Furthermore, in order to achieve the object, the method of manufacturing nanofibers according to an aspect of the present invention by electrically stretching a solution in space includes: effusing the solution from an effusing body into the space, the effusing body having: a plurality of effusing holes; a tip part in which openings at ends of the effusing holes are provided at given intervals to form one-dimensional array; and two side wall parts provided to extend along both sides of the array of the effusing holes and rise from the tip part such that distance between the side wall parts increases in going away from the tip part; and applying a given voltage between the effusing body and a charging electrode disposed at a given distance from the effusing body.

With this, the spaces between the openings of the effusing holes arranged at given intervals are filled with the tip part so that interference of electric fields is less likely to occur. As a result, the intervals between the openings from which a solution effuses are minimized and a production rate of nanofibers per unit area is increased.

In addition, in the structure in which the distance between the side wall parts of the effusing body is smallest at the tip part and increases with distance from the openings, only limited ionic wind generated at the side wall parts flies in a direction such that the ionic wind causes a negative impact on the resulting nanofibers. In addition, ionic wind is not likely to be generated at the surfaces of the side wall parts extending along the direction in which the openings are arranged. The effusing body can thus limit the effects of ionic wind on nanofibers.

3. Advantageous Effects of the Invention

According to the present invention, productivity of nanofibers and quality of the nanofibers are increased.

DETAILED DESCRIPTION OF THE EMBODIMENTS

The following describes a nanofiber manufacturing apparatus and a method of manufacturing nanofibers according to the present invention with reference to the drawings.

Figure 1:
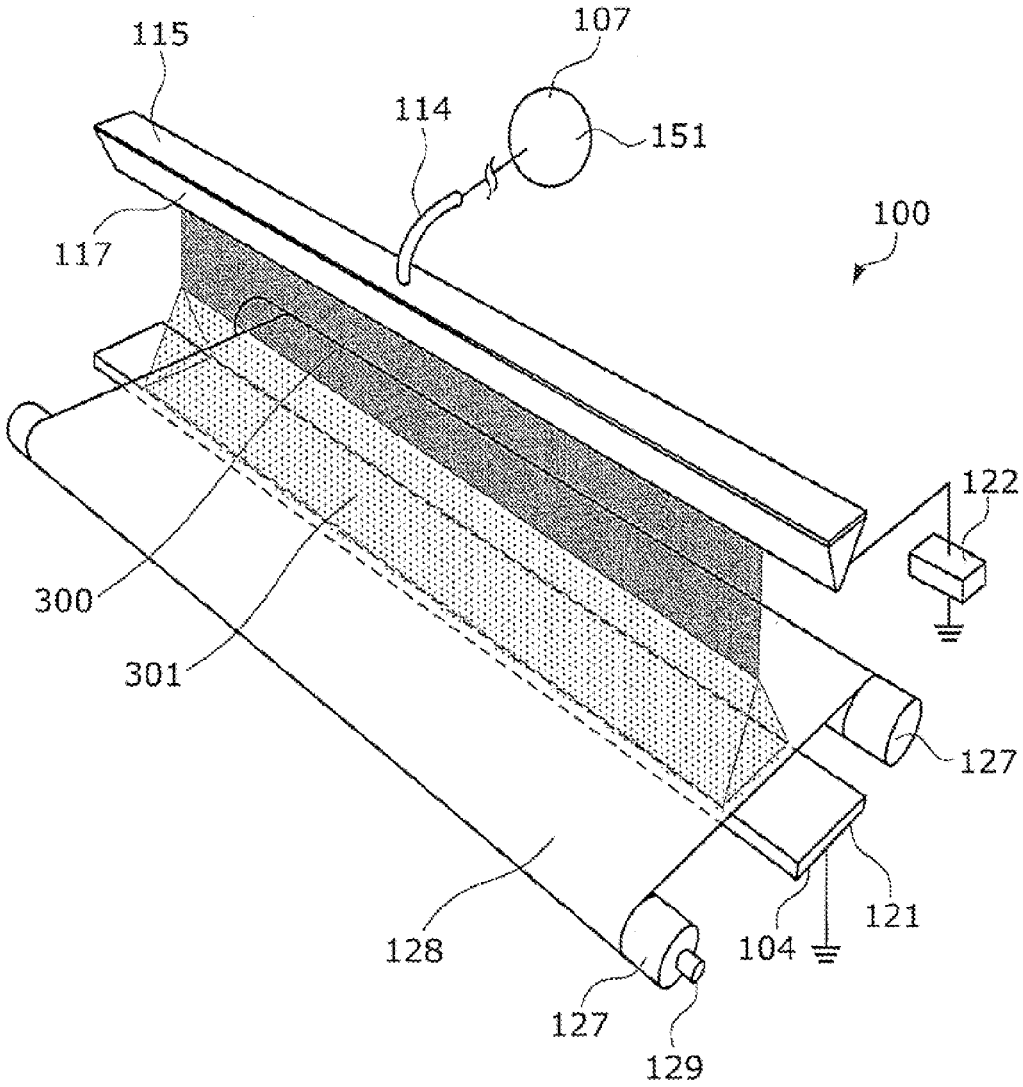
FIG. 1 is a perspective view illustrating a nanofiber manufacturing apparatus.

FIG. 1 is a perspective view illustrating a nanofiber manufacturing apparatus.

As shown in FIG. 1, a nanofiber manufacturing apparatus 100, which is an apparatus for manufacturing nanofibers 301 by electrically stretching a solution 300 in space, includes an effusing body 115, a supply unit 107, a charging electrode 121, and a charging power supply 122. In an embodiment of the present invention, the nanofiber manufacturing apparatus 100 further includes an accumulating unit 128 and an attracting unit 104. In addition, the nanofiber manufacturing apparatus 100 includes a moving unit 129.

Figure 2:
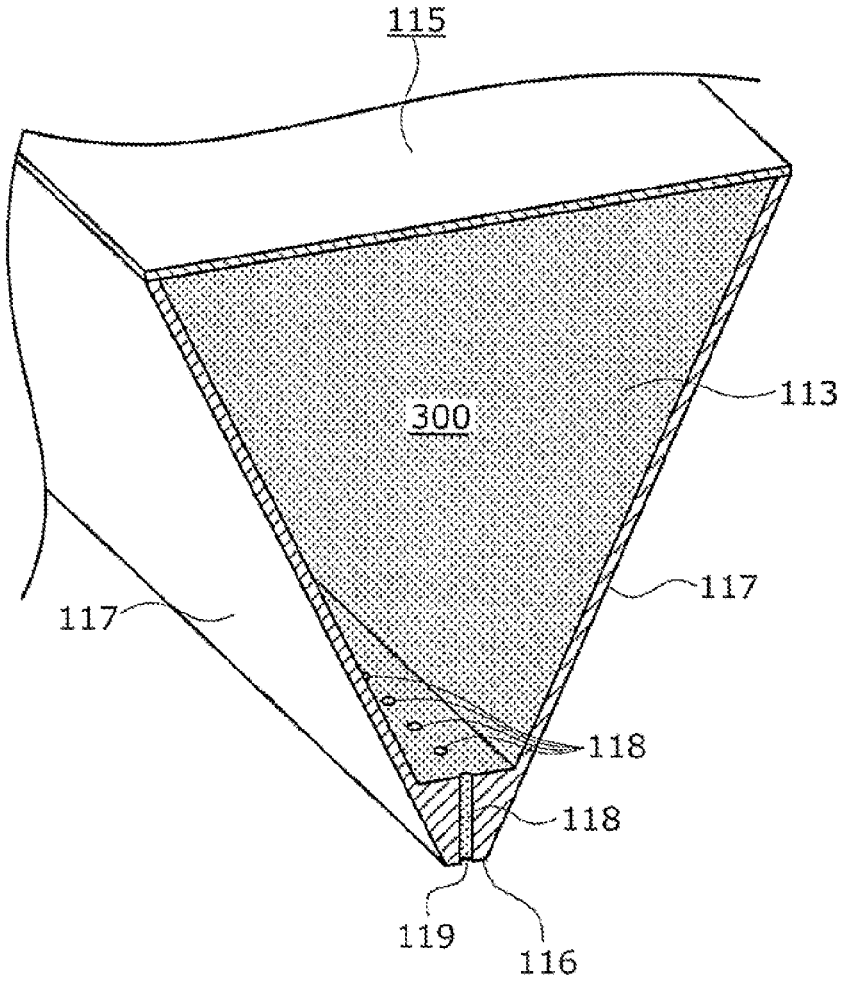
FIG. 2 is a perspective view illustrating a cutaway of the effusing body.

FIG. 2 is a perspective view illustrating a cutaway of the effusing body.

The effusing body 115 is a member for effusing the solution 300 into space by pressure of the solution 300 (and the gravity in some cases). The effusing body 115 has effusing holes 118, a tip part 116, side wall parts 117, and a storage tank 113. The effusing body 115 also includes a conductive member on at least part of the surface in contact with the solution 300 so as to function as an electrode to provide charges to the solution 300 which effuses from the effusing body 115. In the present embodiment, the effusing body 115 is made of metal in whole. The metal to be used as a material for the effusing body 115 is not limited to a specific type of metal and may be any conductive metal such as brass or stainless steel.

The effusing holes 118 are holes provided in the effusing body 115 and allow the solution 300 to effuse therethrough in a given direction. The openings 119 at the ends of the respective effusing holes 118 are one-dimensionally arranged at constant intervals. In the present embodiment, the effusing holes 118 are arranged such that the openings 119 lineally align to be coplanar and that the axels of the effusing holes 118 are perpendicular to the direction in which the openings 119 align.

The effusing holes 118 do not have a specifically limited length or diameter and are formed to have a shape appropriate for conditions such as the viscosity of the solution 300. Specifically, the effusing holes 118 preferably have a length within a range from 1 mm to 5 mm and a diameter within a range from 0.1 mm to 2 mm. The shape of the effusing holes 118 is not limited to a cylindrical shape and any shape may be selected for the shape as necessary. In particular, the shape of the openings 119 is not limited to a circular shape and may be a polygonal shape such as a triangle or a quadrilateral, and even a concave shape such as a star polygon.

All the intervals between the openings 119 may be the same. Alternatively, the intervals between the openings 119 in the end parts of the effusing body 115 may be larger (or smaller) than the intervals between the openings 119 in the middle part of the effusing body 115 as necessary. As far as the inventors have so far found, the pitches between the openings 119 having a diameter of 0.3 mm can be as small as 2.5 mm. The diameter and pitch of the openings 119 may be changed depending on conditions such as the viscosity of the solution 300.

The arrangement of the openings 119 is not limited to a linear arrangement and may be any one-dimensional arrangement. Here, "one-dimensional" means that the openings 119 do not align in the direction of the width of a rectangle outlining a region in which all the openings 119 are included with no margin along the sides of the region. The rectangular region including the openings 119 is a strip-shaped region. In this meaning, the opening 119 may be arranged in a zigzag manner or along a wavy line such as a sine curve.

The tip part 116 is a part of the effusing body 115. The openings 119 of the effusing holes 118 are provided in the tip part 116 at regular intervals. The tip part 116 has a smooth surface which fills the intervals between the openings 119. In the present embodiment, the tip part 116 has an elongated rectangular flat face on its surface, and is designed to have a width larger than the diameter of the openings 119. The width of the tip part 116 depends on the diameter of the effusing holes 118. The tip part 116, for a specific example, is preferably designed to have a width larger than 1 mm in consideration of the bases of Taylor cones 303 (described later, see FIG. 3) having a diameter of 1 mm.

Figure 3:
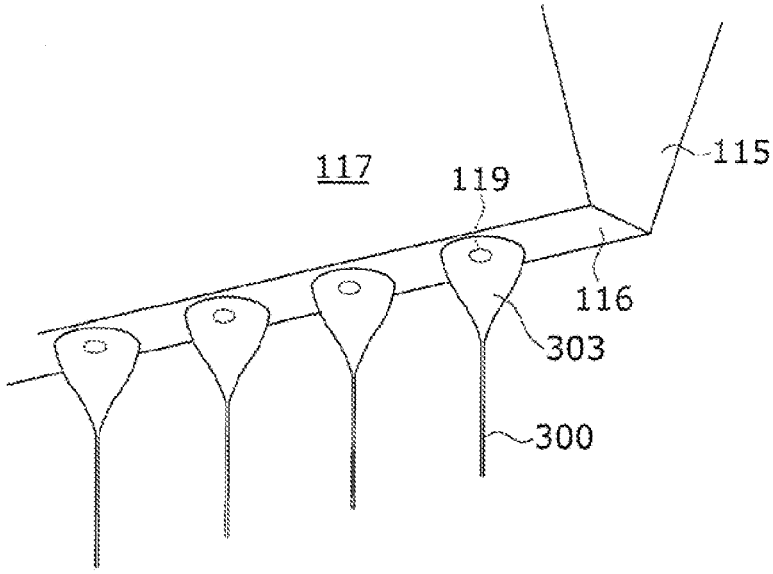
FIG. 3 is a perspective view illustrating the effusing body viewed from the side of the tip part.

The tip part 116 having a flat surface is present all around the openings 119 so that Taylor cones 303 are formed around the respective openings 119 as shown in FIG. 3. The Taylor cones 303 are cones of the solution. They are considered to form due to the viscosity of the solution 300. Each of the Taylor cones 303 has a conical shape with a circular base having a diameter larger than the opening 119. The Taylor cones 303 attach to the tip part 116 of the effusing body 115 so as to cover the openings 119. The solution 300 thinly effuses into space from each of the Taylor cones 303. The Taylor cones 303 prevent the openings 119 from being in direct contact with air so that ionic wind generated from the openings 119 can be prevented.

Figure 4:
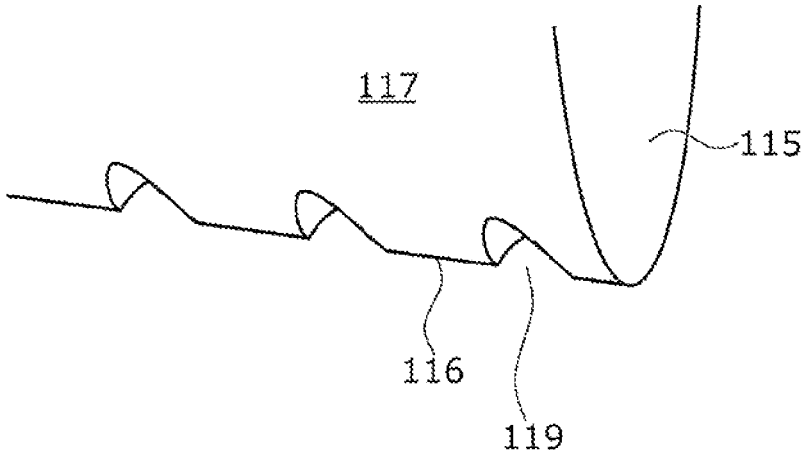
FIG. 4(*a*)-4(*b*) are perspective views illustrating variations of the tip part.
Figure 4:
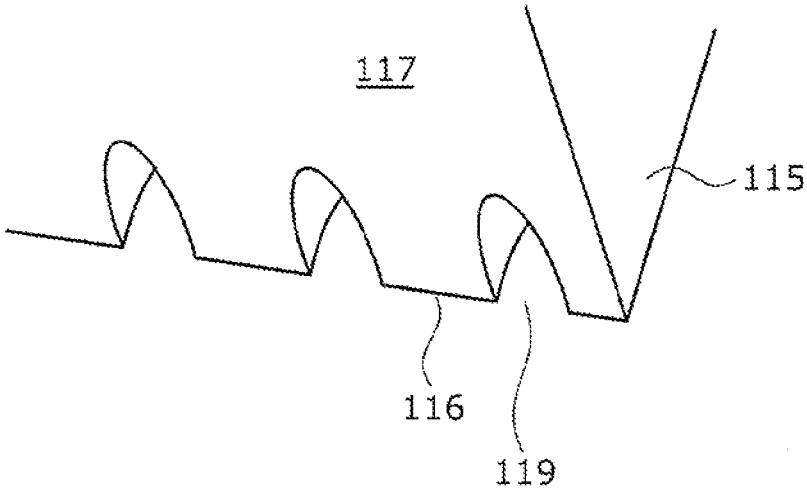

It is to be noted that the shape of the tip part 116 is not limited to a shape having a flat rectangular surface and that the Taylor cones 303 may form on a non-flat surface. For example, the tip part 116 may have a curved surface as shown in FIG. 4(*a*). Alternatively, the tip part 116 may have two flat surfaces which meet each other at their ends as shown in FIG. 4(*b*).

Alternatively, when the openings 119 are arranged in a zigzag manner or along a wavy line as mentioned above, the tip part 116 may be a straight strip-shaped part or may have a shape following the array of the openings 119, such as a zigzag shape or a wavy shape.

The tip part 116 thus has a surface which fills the intervals between the openings 119 (two surfaces which fill the intervals in FIG. 4(*b*) as described above) so that interference of electric fields between nozzles arranged close to each other can be prevented. In addition, generation of ionic wind between the openings 119 is also prevented. Therefore, favorable nanofibers 301 can be produced even when the openings 119 are arranged with narrower intervals. As a result, productivity of nanofibers 301 per unit time and unit area can be increased.

In addition, because the tip parts 116 can retain the Taylor cones 303 in a favorable status, generation of ionic wind is prevented so that quality and productivity of the nanofibers 301 can be improved.

Referring to FIG. 2, the side wall parts 117 are two walls provided so as to have the effusing holes 118 located therebetween, and are parts of the effusing body 115, extending upward from the tip part 116. In addition, the side wall parts 117 extend along the direction in which the effusing holes 118 are arranged so that all the effusing holes 118 are located between the two side wall parts 117. In addition, the side wall parts 117 are provided so that the distance therebetween increases with distance from the tip part 116 as shown in FIG. 2. The more acute the angle between the side wall parts 117 is, the more charges can be concentrated at the tip part, and thereby high-quality nanofibers 301 can be produced from the solution 300 having a high charge density. On the other hand, the more acute the angle between the side wall parts 117 is, the smaller the volume of the storage tank 113 of the effusing body 115 and the more difficult the processing for providing the effusing body 115 with the storage tank 113 is. Taking these conditions into considerations, a preferable angle between the side wall parts 117 is approximately 60 degrees. It is to be noted that the angle between the side wall parts 117 of the effusing body 115 is not limited to this.

Figure 7:
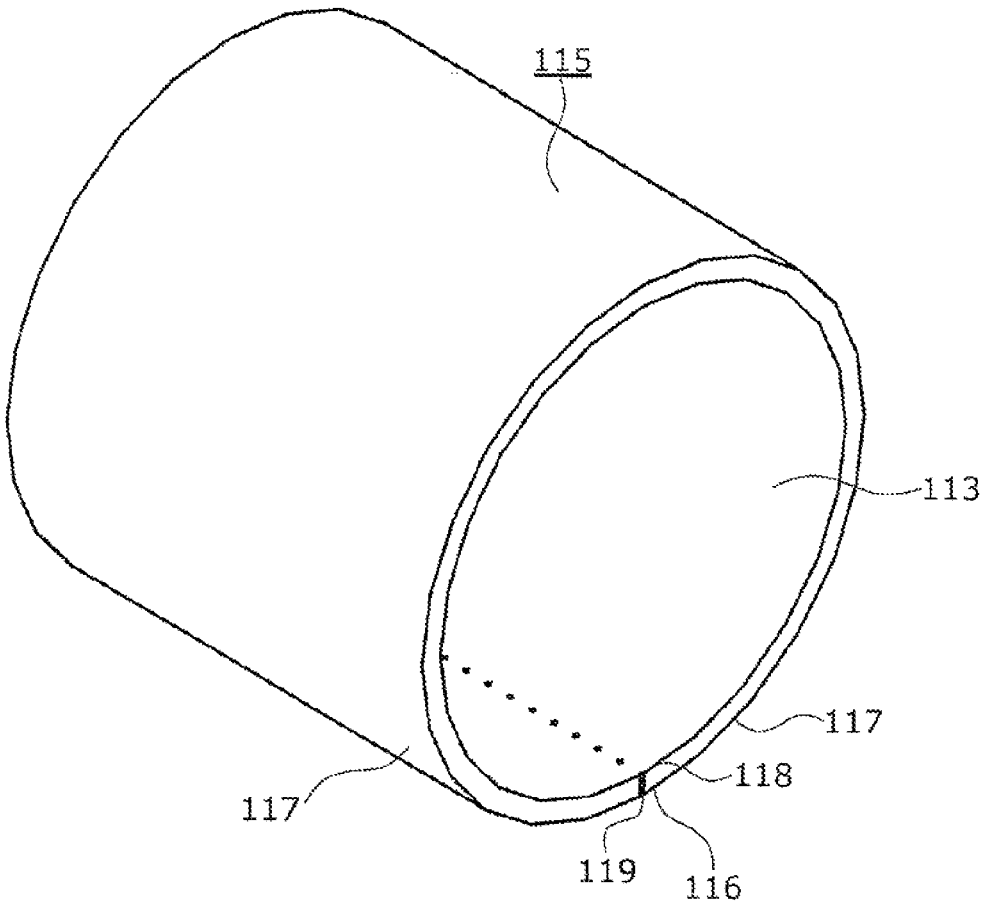
FIG. 7 is a perspective view illustrating a cutaway of an effusing body having a different shape.
Figure 8:
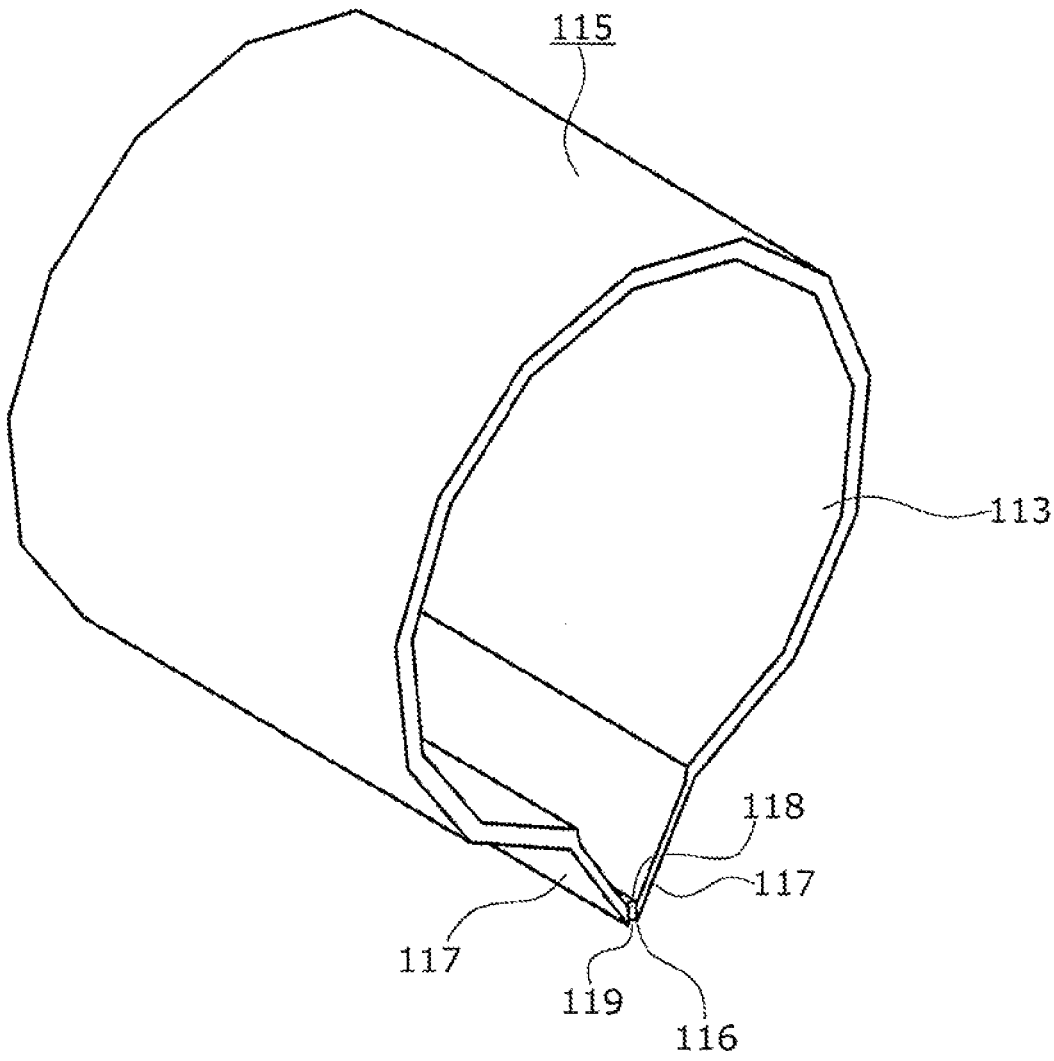
FIG. 8 is a perspective view illustrating a cutaway of an effusing body having a different shape.
Figure 9:
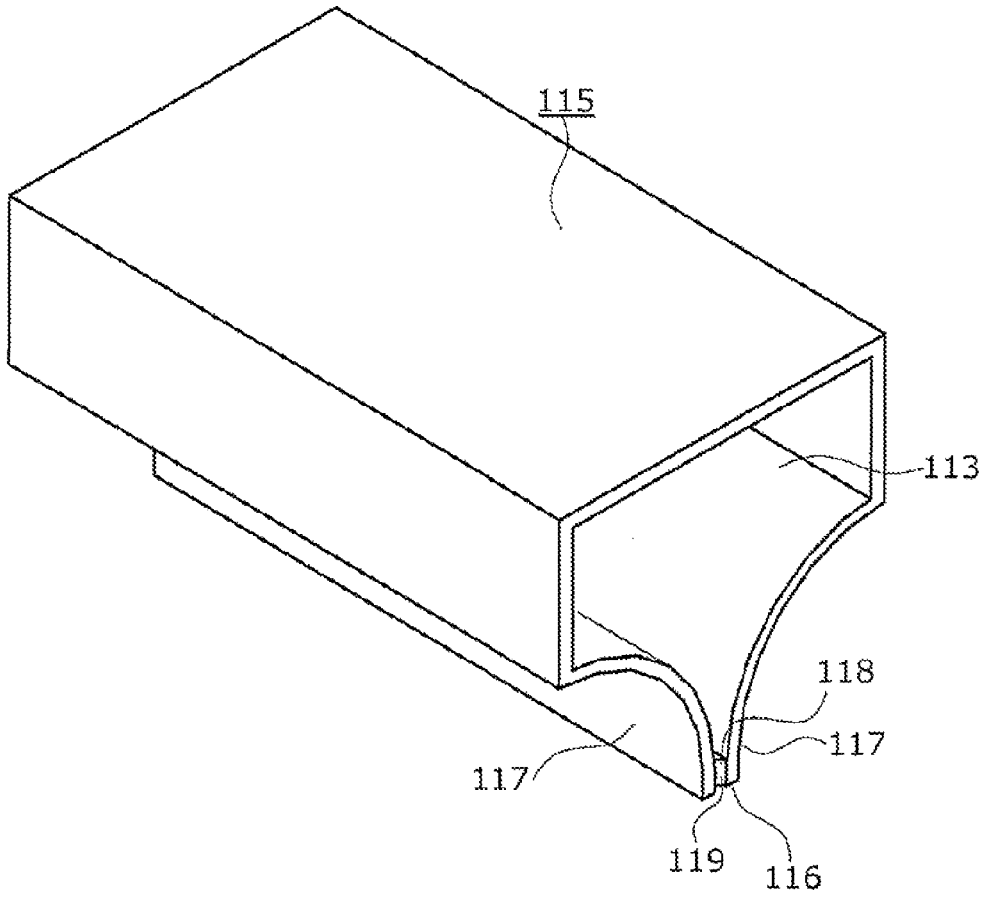
FIG. 9 is a perspective view illustrating a cutaway of an effusing body having a different shape.
Figure 10:
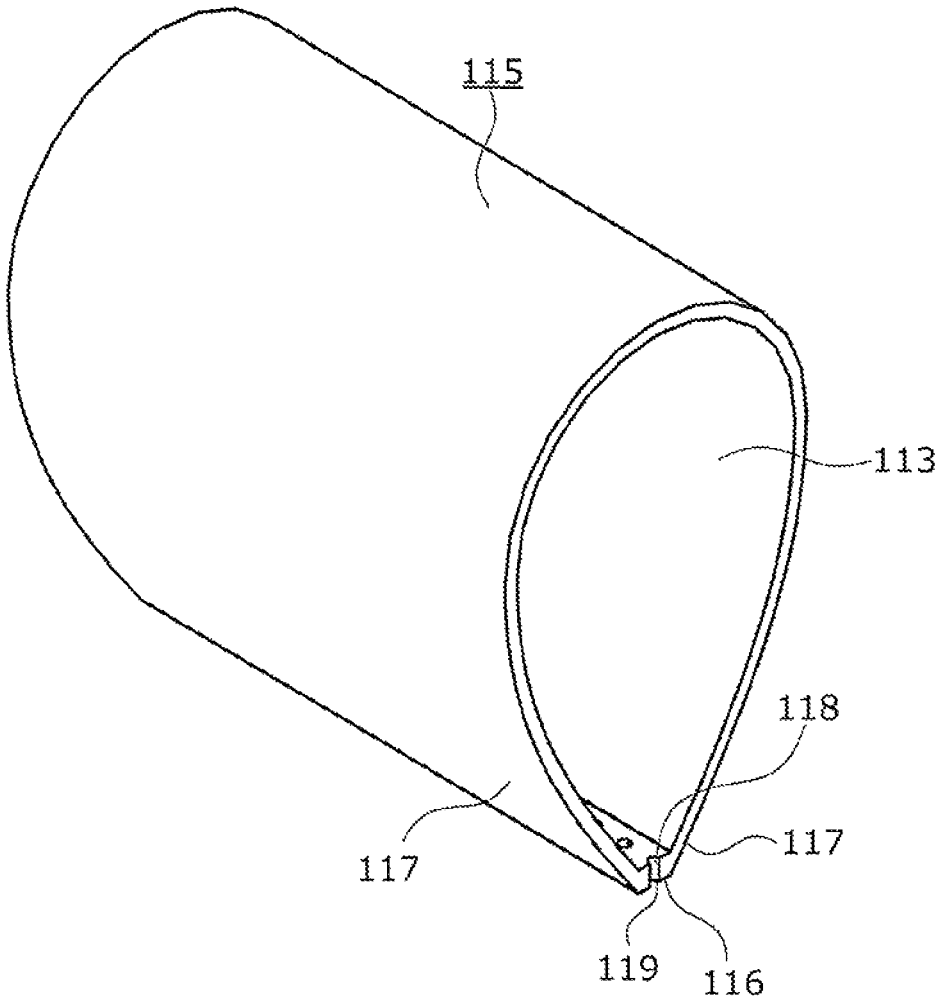
FIG. 10 is a perspective view illustrating a cutaway of an effusing body having a different shape.

As shown in FIG. 4(*a*) and FIG. 4(*b*), there is no definite boundary between the tip part 116 and the side wall parts 117. In addition, the shape of the side wall parts 117 is not limited to a flat shape. The side wall parts 117 may have a curved shape. For example, in the case where the effusing holes 118 are provided in the circumferential wall of the cylindrical effusing body 115 as shown in FIG. 7, the part where the effusing holes 118 are provided in the circumferential wall of the cylindrical effusing body 115 serves as the tip part and the parts on both sides of the tip part (the part where the effusing holes 118 are provided) serve as the side wall parts 117. In this case, a member to be included in the effusing body 115 is easily obtainable and the member can be easily processed into the effusing body 115. On the other hand, the effusing body 115 having such a shape concentrates fewer charges at the tip part 116 than the effusing body 115 having another shape (for example, the shape of the effusing body 115 as shown in FIG. 2), but the difference can be compensated by using a higher voltage or changing the position or shape of the charging electrode 121. Alternatively, the effusing body 115 may have a flat shape in the side wall parts 117 and a cylindrical shape in the part where the storage tank 113 is provided as shown in FIG. 8. Alternatively, the side wall parts 117 on both sides of the tip part 116 may form a curved shape such that the distance between the side wall parts 117 increases with distance from the tip part 116, and the part where the storage tank 113 is provided may have a rectangular-tubular shape as shown in FIG. 9. Alternatively, the effusing body 115 may be a cylinder having an oval cross section as shown in FIG. 10.

The side wall parts 117 as illustrated above are provided so that the distance therebetween increases with distance from the tip part 116, and extend in a direction along the array of the effusing holes 118 located between the side wall parts 117. The effusing body 115 obtained by combining the parts of the above-illustrated variations of the effusing body 115 is also within the scope of the present invention. The side wall parts 117 are part of the effusing body 115 and have continuous faces such that the distance therebetween increases with the distance from the tip part 116.

The side wall parts 117 and the tip part 116 preferably have smooth surfaces overall and have minimum specific parts (but necessarily have the openings 119) such that generation of ionic wind is prevented.

The effusing body 115 has the side wall parts 117 such that generation of ionic wind is prevented. In addition, even when ionic wind is generated, the wind is blown off in a direction such that the ionic wind does not cross the solution 300 effusing into space. It is thus possible to produce nanofibers 301 in stable conditions with no impact of the ionic wind.

The arrangement in which the side wall parts 117 come closer to each other toward the tip part 116 makes it easy to concentrate charges at the tip part 116, and thus charges can be efficiently supplied to the solution 300.

In addition, as the space around the openings 119 is widely open, it is possible to prevent charged vapor from congesting around the openings 119. Viewed from another viewpoint, such congestion of charged vapor is actively prevented by a flow of gas along the side wall parts 117.

In addition, for example, when wind is generated which blows from near the openings 119 toward the downstream of the effusion of the solution 300, charged vapor and ionic wind are driven off from the side wall parts 117 in the (downward) direction along the flight path of the solution 300. As a result, quality of the resulting nanofibers 301 can be increased.

As shown in FIG. 2, the storage tank 113 is provided inside the effusing body 115 and stores the solution 300 supplied from the supply unit 107 (see FIG. 1). The storage tank 113 is connected to the effusing holes 118 and supplies the solution 300 to the effusing hole 118. In the present embodiment, one storage tank 113 is provided in the effusing body 115, extending from one of the ends of the effusing body 115 to the other end thereof so that the storage tank 113 is connected to all the effusing holes 118.

The storage tank 113 thus has a function of temporarily storing the solution 300 near the effusing holes 118 and a function of supplying the solution 300 to the effusing holes 118 at an even pressure so that the solution 300 effuses from the effusing holes 118 in a uniform status. As a result, spatial unevenness in quality of the resulting nanofibers 301 is avoided.

The supply unit 107 includes a container 151, a pump (not shown in the drawing), and a guide tube 114 as shown in FIG. 1 to supply the solution 300 to the effusing body 115. The container 151 stores the solution 300 in large quantity. The pump transfers the solution 300 with a given pressure. The guide tube guides the solution 300.

The charging electrode 121 is disposed at a given distance from the effusing body 115 and induces charges into the effusing body 115 by having a high voltage or a low voltage compared to the effusing body 115. In the present embodiment, the charging electrode 121 is disposed at a position facing the tip part 116 of the effusing body 115 and is grounded so that the charging electrode 121 functions as an attracting unit 104 which attracts the nanofibers 301. When a positive voltage is applied to the effusing body 115, negative charges is are induced into the charging electrode 121. When a negative voltage is applied to the effusing body 115, positive charges are induced into the charging electrode 121.

The charging power supply 122 is a power supply capable of applying a high voltage to the effusing body 115. Generally, the charging power supply 122 is preferably a direct-current power supply. In particular, use of a direct current is preferable when the charging power supply 122 is free from the impact of the charge polarity of the resulting nanofibers 301 or when the nanofibers 301 are attracted by an electrode to which a potential of a reverse polarity is applied. When the charging power supply 122 is a direct-current power supply, the voltage which the charging power supply 122 applies to the charging electrode 121 is preferably within a range from 5 kV to 100 kV.

The charging electrode 121 is grounded by setting one of the electrodes of the charging power supply 122 at a ground potential as in the present embodiment even when the charging electrode 121 is relatively large, so that safety of the nanofiber manufacturing apparatus is improved.

The solution 300 may be charged by grounding the effusing body 115 and keeping the charging electrode 121 at a high voltage with a power supply connected to the charging electrode 121. The charging electrode 121 and the effusing body 115 are not necessarily grounded.

The accumulating unit 128 is a member on which the nanofibers 301 produced by electrostatic stretching are accumulated. In the present embodiment, the accumulating unit 128 is a sheet member made of tungsten, which is a material for a capacitor, an electric device, and provided as a rolled sheet, a roll 127.

The accumulating unit 128 is not limited to this. For example, the accumulating unit 128 may be a stiff plate-like member. When only the accumulated nanofibers 301 are used, the accumulating unit 128 may be a sheet which allows easy removal of the nanofibers 301 therefrom, for example, a fluoroplastic coated sheet or a silicon-coated sheet.

The attracting unit 104 is an apparatus which attracts the nanofibers 301 produced in space to the accumulating unit 128. In the present embodiment, the attracting unit 104 is a metal plate which also functions as the charging electrode 121 and is disposed behind the accumulating unit 128 as viewed from the effusing body 128. The attracting unit 104 attracts the nanofibers 301 charged to the accumulating unit 128 by an electric field. In other words, the attracting unit 104 is an electrode which generates an electric field to attract the nanofibers 301 charged.

The moving unit 129 is a device which moves at least one of the effusing body 115 and the accumulating unit 128 relative to each other. In the present embodiment, the effusing body 115 is fixed and only the accumulating unit 128 is moved by the moving unit 129. Specifically, the moving unit pulls out the accumulating unit 128 having a long length by rolling it up from the roll 127, and transfers the accumulating unit 128 along with the accumulated nanofibers 301.

The moving unit 129 may not only move the accumulating unit 128 but also move the effusing body 115 in relation to the accumulating unit 128. In another example of the operation of the accumulating unit 128, the moving unit 129 may move the accumulating unit 128 in any necessary manner. For example, the moving unit 129 may move the accumulating unit 128 in a given direction to reciprocate the effusing body 115. The direction in which the accumulating unit 128 moves is not limited to the direction perpendicular to the array of the openings 119 as in the present embodiment. The accumulating unit 128 may move in the direction along the array of the openings 119 so that the effusing body 115 reciprocates in the direction perpendicular to the array of the openings 119.

Here, the solute which is to be dissolved or dispersed in the solution 300 and is to be a resin contained in the nanofibers 301 is a high molecular substance. Examples of the high molecular substance include polypropylene, polyethylene, polystyrene, polyethylene oxide, polyethylene terephthalate, polybutylene terephthalate, polyethylene naphthalate, poly-m-phenylene terephthalate, poly-p-phenylene isophthalate, polyvinylidene fluoride, polyvinylidene fluoride-hexafluoropropylene copolymer, polyvinyl chloride, polyvinylidene chloride-acrylate copolymer, polyacrylonitrile, polyacrylonitrile-methacrylate copolymer, polycarbonate, polyarylate, polyester carbonate, polyamide, aramid, polyimide, polycaprolactone, polylactic acid, polyglycolic acid, collagen, polyhydroxybutyric acid, polyvinyl acetate, polypeptide, and a copolymer thereof. The oxide may be the one selected from among the above substances or a mixture thereof. The substances are given for illustrative purposes only and the present invention is not limited to the resins.

The solvent to be used as the solution 300 may be a volatile organic solvent. Specific examples of the solvent include methanol, ethanol, 1-propanol, 2-propanol, hexafluoroisopropanol, tetraethylene glycol, triethylene glycol, dibenzyl alcohol, 1,3-dioxolane, 1,4-dioxane, methyl ethyl ketone, methyl isobutyl ketone, methyl-n-hexyl ketone, methyl-n-propyl ketone, diisopropyl ketone, diisobutyl ketone, acetone, hexafluoroacetone, phenol, formic acid, methyl formate, ethyl formate, propyl formate, methyl benzoate, ethyl benzoate, propyl benzoate, methyl acetate, ethyl acetate, propyl acetate, dimethyl phthalate, diethyl phthalate, dipropyl phthalate, methyl chloride, ethyl chloride, methylene chloride, chloroform, o-chlorotoluene, p-chlorotoluene, chloroform, carbon tetrachloride, 1,1-dichloroethane, 1,2-dichloroethane, trichloroethane, dichloropropane, dibromoethane, dibromopropane, methyl bromide, ethyl bromide, propyl bromide, acetic acid, benzene, toluene, hexane, cyclohexane, cyclohexanone, cyclopentane, o-xylene, p-xylene, m-xylene, acetonitrile, tetrahydrofuran, N,N-dimethylformamide, N,N-dimethylacetamide, dimethyl sulfoxid, pyridine, and water. The oxide may be the one selected from among the above substances or a mixture thereof. The substances are given for illustrative purposes only and the solution 300 used in the present invention is not limited to the solvents above.

In addition, an additive of an inorganic solid material may be added to the solution 300. The inorganic solid material may be an oxide, a carbide, a nitride, a boride, a silicide, a fluoride, or a sulfide. However, in view of preferable properties, such as thermal resistance and workability, of the nanofibers 301 to be manufactured, an oxide is preferable among them. Examples of the additive include $Al_2O_3$, $SiO_2$, $TiO_2$, $Li_2O$, $Na_2O$, MgO, CaO, SrO, BaO, $B_2O_3$, $P_2O_5$, $SnO_2$, $ZrO_2$, $K_2O$, $Cs_2O$, ZnO, $Sb_2O_3$, $As_2O_3$, $CeO_2$, $V_2O_5$, $Cr_2O_3$, MnO, $Fe_2O_3$, CoO, NiO, $Y_2O_3$, $Lu_2O_3$, $Yb_2O_3$, $HfO_2$, and $Nb_2O_5$. The oxide may be the one selected from among the above substances or a mixture thereof. The substances are given for illustrative purpose only and the additive to be added to the solution 300 in the present invention is not limited to the substances.

The mixture ratio between the solvent and the solute in the solution 300 depends on the selected solvent and the selected solute. A desirable amount of solvent accounts for approximately 60 to 98 weight percent. A preferable amount of solute accounts for 5 to 30 weight percent.

The following describes a method of manufacturing the nanofibers 301 using the nanofiber manufacturing apparatus 100.

First, the supply unit 107 supplies the solution 300 to the effusing body 115 (a supply step). The storage tank 113 of the effusing body 115 is thus filled with the solution 300.

Next, the charging power supply 122 sets the charging electrode 121 at a positive or negative high voltage. Then, charges concentrate at the tip part 116 of the effusing body 115 facing the charging electrode 121, and the charges transfer to the solution 300 which effuses through the effusing holes 118 into space, so that the solution 300 is charged (a charging step).

The charging step and the supply step are simultaneously performed so that the solution 300 charged effuses from the end openings 119 of the effusing body 115 (an effusing step).

Here, the solution 300 effusing from the openings 119 forms Taylor cones 303 which cover the openings 119 and hang from the tip part 116. Each of the Taylor cones 303 is formed to cover a corresponding one of the openings 119. The solution 300 forms a thread-like shape hanging down from the tip of each of the Taylor cones 303. The Taylor cones 303 thus formed prevent generation of ionic wind so that quality of resulting nanofibers 301 can be increased.

Next, the solution 300 flying in space for a certain distance is electrostatically stretched so that the nanofibers 301 are produced (a nanofiber producing step). Here, the solution 300 effusing is highly charged (that is, at a high charge density) with no impact of ionic wind and the solution 300 flying out of the openings 119 form thin threads without uniting each other in flight. Most of the solution 300 thus turns to the nanofibers 301. On the other hand, because the solution 300 effusing is highly charged (that is, at a high charge density), the electrostatic stretching repeatedly occurs so that nanofibers 301 having a thin diameter are produced in large quantity.

In this condition, an electric field generated between the effusing body 115 and the attracting unit 104 disposed behind the accumulating unit 128 as viewed from the effusing body 115 attracts the nanofibers 301 to the accumulating unit 128 (an attracting step).

The nanofibers 301 are thus accumulated on the accumulating unit 128, and then are collected (a collecting step). The accumulating unit 128 is slowly transferred by the moving unit 129 so that each of the nanofibers 301 has a band-like shape extending in the direction of the transfer.

The method of manufacturing nanofibers using the nanofiber manufacturing apparatus 100 configured in the above manner enables production of high quality nanofibers 301 at high productivity, eliminating spatial unevenness.

Figure 5:
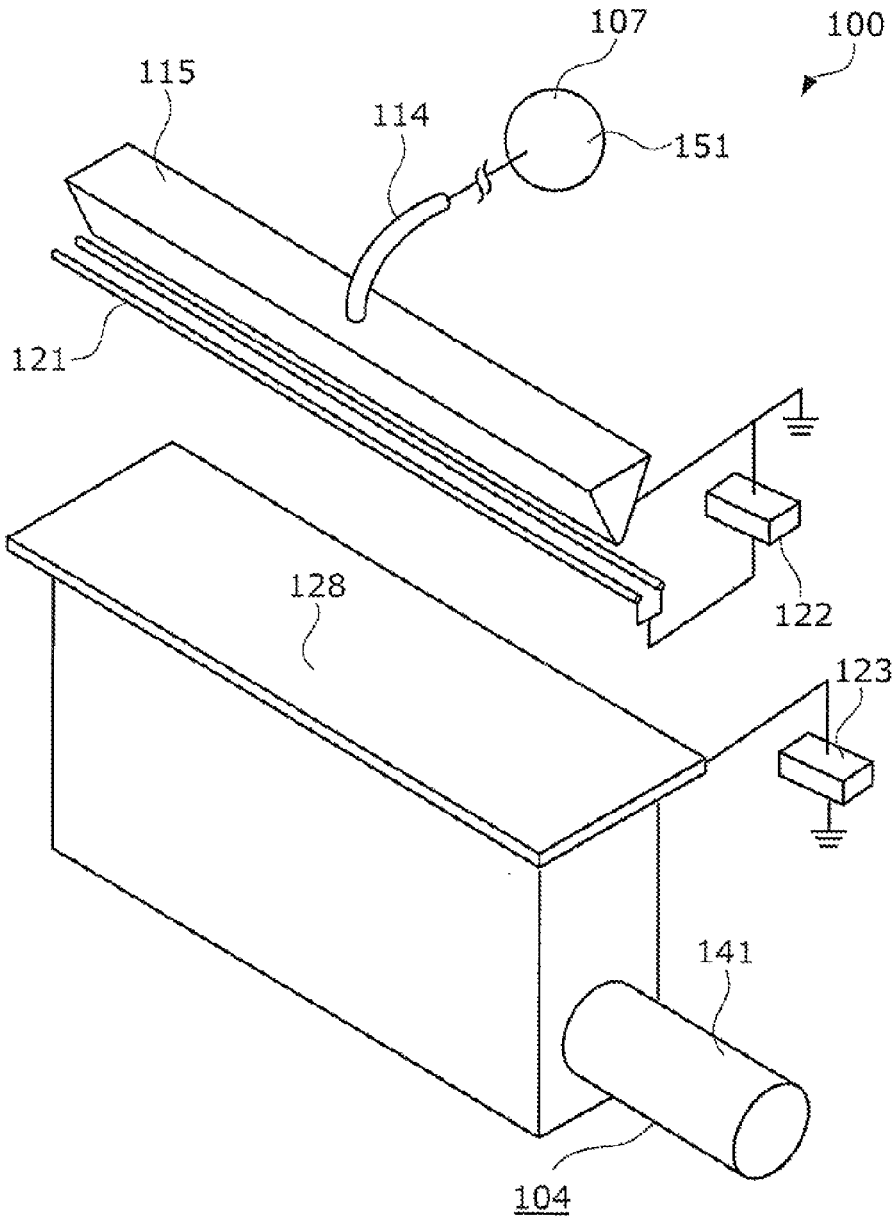
FIG. 5 is a perspective view illustrating another embodiment of the nanofiber manufacturing apparatus.

It is to be noted that present invention is not limited to the above embodiment. For example, the charging electrode 121 may be disposed between the effusing body 115 and the accumulating unit 128 so as to be close to the effusing body 115 as shown in FIG. 5. The nanofiber manufacturing apparatus 100 in such an embodiment may further include an accumulating unit 128 which is air-permeable and on which nanofibers 301 are accumulated, and an attracting unit 104 which generates a gas flow to converge at a predetermined part. Specifically, as shown in FIG. 5, the nanofiber manufacturing apparatus 100 may include a vacuum aspiration device 141 disposed such that the vacuum aspiration device 141 functions as the attracting unit 104 by generating a gas flow which blows from behind the accumulating unit 128 toward the accumulating unit 128. In addition, the nanofiber manufacturing apparatus 100 may further include an accumulation power supply 123 provided separately from (or functionally integrated with) the charging power supply 122 so that the nanofibers 301 are attracted by an electric field and by a gas flow, selectively or simultaneously.

Figure 6:
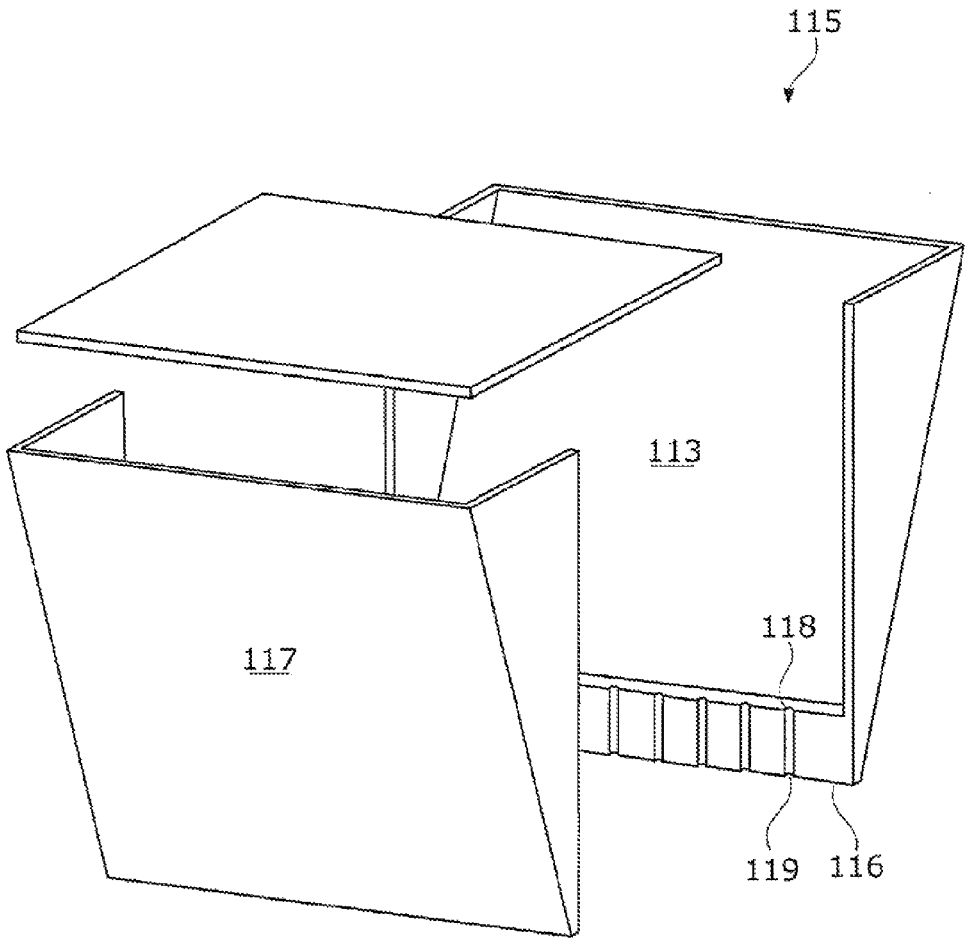
FIG. 6 is a perspective view illustrating an effusing body which allows disassembly into parts.

Alternatively, the effusing body 115 may have a structure which allows disassembly of the effusing body 115 into parts as shown in FIG. 6. In particular, a structure which allows disassembly so as to expose inner surfaces of the effusing holes 118 is preferable because objects in the effusing holes 118 such as a resin adherent thereto can be easily removed.

The present invention is applicable to manufacture of nanofibers and spinning using nanofibers, and manufacture of unwoven fabric of nanofibers.

REFERENCE SIGNS LIST

100 Nanofiber manufacturing apparatus
104 Attracting unit
107 Supply unit
113 Storage tank
114 Guide tube
115 Effusing body
116 Tip part
117 Side wall part
118 Effusing hole
119 Opening
121 Charging electrode
122 Charging power supply
127 Roll
128 Accumulating unit
129 Moving unit
151 Container
300 Solution
301 Nanofiber

The invention claimed is:

1. A method of manufacturing nanofibers by electrically stretching a solution in space, said method comprising:

providing an effusing body including a tip part having an elongated flat face, a plurality of effusing holes terminating in openings in an outer surface of the elongated flat face, and two side wall parts extending along both sides of the effusing holes, the side wall parts rising from the tip part such that the distance between the side wall parts increases in a direction away from the tip part, wherein the openings are disposed at given intervals to form a one-dimensional array and the tip part has a width that is larger than a diameter of the openings;

supplying the solution to the effusing body;

forming and retaining cones of the solution on the elongated flat face of the tip part of the effusing body, wherein the cones of the solution cover the openings;

effusing, into the space, the solution from the cones of the solution that are formed and retained on the elongated flat face of the tip part of the effusing body; and applying a given voltage between the effusing body and a charging electrode disposed at a given distance from the effusing body to produce the nanofibers.

2. The method of manufacturing nanofibers according to claim 1, further comprising:

accumulating the nanofibers produced in the space on an accumulating unit; and attracting the nanofibers to the accumulating unit.

3. A method of manufacturing nanofibers by electrically stretching a solution in space, said method comprising:

providing an effusing body including a tip part having an elongated flat face, a plurality of effusing holes terminating in openings in an outer surface of the elongated flat face, the openings being disposed at given intervals to form an array in a longitudinal direction of the tip part; and two side wall parts extending along both sides of the array of the effusing holes, the side wall parts rising from the tip part such that the distance between the side wall parts increases in a direction away from the tip part, wherein the tip part has a smooth outer face connecting the openings;

supplying the solution to the effusing body;

forming and retaining cones of the solution on elongated flat face of the tip part of the effusing body, wherein the cones of the solution are formed around the openings so as to cover the openings;

effusing, into the space, the solution from the cones of the solution formed and retained on the tip part of the effusing body; and applying a given voltage between the effusing body and a charging electrode disposed at a given distance from the effusing body to produce nanofibers.

4. The method of manufacturing nanofibers according to claim 3, further comprising accumulating the nanofibers produced in the space on an accumulating unit; and attracting the nanofibers to the accumulating unit.

* * * * *